US006889583B1

(12) United States Patent
Zucker

(10) Patent No.: US 6,889,583 B1
(45) Date of Patent: May 10, 2005

(54) POLYAXIAL IMPACT TOOL

(76) Inventor: Fred Zucker, 18295 Lake Bend Dr., Jupiter, FL (US) 33458

( * ) Notice: Subject to any disclaimer, the term of this patent is extended or adjusted under 35 U.S.C. 154(b) by 2 days.

(21) Appl. No.: 10/824,888

(22) Filed: Apr. 14, 2004

(51) Int. Cl.[7] ..... B25B 19/00
(52) U.S. Cl. ..... 81/463; 81/177.1; 81/177.7
(58) Field of Search ..... 81/463, 177.1, 81/177.7, 177.8, 177.9, 465, 489, 466, 180.1, 492, 177.2, 427.5

(56) References Cited

U.S. PATENT DOCUMENTS 1,850,239 A 3/1932 McCarthy
1,923,122 A 8/1933 Smith
4,436,004 A * 3/1984 Chang ..... 81/60
4,538,479 A * 9/1985 Blessing ..... 74/528
4,807,349 A 2/1989 Blackmore
5,161,440 A 11/1992 Jordan
5,911,798 A * 6/1999 Arnold ..... 81/177.2

* cited by examiner

*Primary Examiner*—Joseph J. Hail, III
*Assistant Examiner*—Alvin J. Grant
(74) *Attorney, Agent, or Firm*—McHale & Slavin, P.A.

(57) ABSTRACT

A polyaxial wrench can apply torque to bolts, nuts and screws in close confines where leverage perpendicular to the axis of the bolt is restricted. The wrench has one end for mounting on the bolt, a shank and a sleeve. The shank extends longitudinally from the one end. The sleeve is rotatably mounted on the shank. The sleeve has connections for coupling an impact tool in several different angular configurations in relation to the longitudinal axis of the sleeve. Therefore, the impact tool can apply force vectors, of choice and dictated by the confines, polyaxially.

7 Claims, 2 Drawing Sheets

POLYAXIAL IMPACT TOOL

FIELD OF THE INVENTION

This invention relates to the field of power tools and more particularly to impact wrenches for turning bolts and nuts by power assist.

BACKGROUND OF THE INVENTION

There are many instances in which it is difficult to gain leverage to apply torque to bolts and/or nuts, usually, because of the proximity of other structures. In addition to tight confines of some machinery, there may be the problem of rust and corrosion adhering the components to each other. In these circumstances, impact tools are used to apply a large amount of force with little leverage. Impact tools range from a simple hammer to air hammers, hydraulic rams and electric ultrasonic drivers.

Concomitantly, it may be impossible to directly apply the force of the impact tools perpendicularly to the axis of rotation of the bolts or nuts. In such situations, a link is required between the impact tool and the bolt to vector the force. Conventionally, the link is used to vector the force only in the plane of rotation.

U.S. Pat. No. 1,923,122 to Smith discloses an impact wrench driven by an air hammer. A conventional open end wrench has a spherical socket mounted on one end. A link having a spherical end and integral arms is rotatably mounted in the socket. The arms are connected with a pin in the shank of the wrench. The other end of the link is to be fitted onto the air hammer. The link can rotate approximately 180 degrees about the pin in a plane perpendicular to the longitudinal axis of the bolt or nut being loosened or tightened.

McCarthy, U.S. Pat. No. 1,850,239, discloses a manual impact wrench having an open end with a shank connected by a pin such that the shank can rotate approximately 180 degrees in a plane perpendicular with the longitudinal axis of the bolt. The end of the shank is formed with a flat surface which may be struck with a hammer.

Blackmore, U.S. Pat. No. 4,807,349, discloses an apparatus and method for breaking frozen or other tight connections between screw threads by using a rivet gun for impulses along the longitudinal axis of the bolt while applying manual rotational force to the threads.

U.S. Pat. No. 5,161,440 to Jordan discloses a box end wrench having a shank with a pivoting arm mounted on one end to pivot in a plane perpendicular to the longitudinal axis of the bolt. The arm may be attached to a ultrasonic or other vibrational energy source to turn the bolt.

What is needed in the art is an impact wrench which can pivot in the plane of rotation of a bolt and can rotate about the longitudinal axis of the wrench.

SUMMARY OF THE PRESENT INVENTION

A polyaxial impact wrench for applying torque to bolts and nuts. The device has a working end configured to closely contact the periphery of the head of a bolt or nut. An elongated shank rigidly extends from the working end. A sleeve is mounted on the elongated shank for circumferential rotation about the longitudinal axis of the shank. The sleeve having a lock to fix the sleeve at different circumferential positions about the shank. The sleeve including a means for connecting an impact tool at different angles to the longitudinal axis of the shank whereby torque can be applied to the working end at varying angles to the longitudinal axis and circumferentially of the shank.

Therefore, it is an objective of this invention to provide an impact wrench having a working end, an intermediate shank and a polyaxial power end.

It is another objective of this invention to provide the shank with a power link pivoting in a the plane of rotation of a bolt attached to the working end.

It is a further objective of this invention to provide the power link with a rotary sleeve adapted to rotate about the longitudinal axis of the impact wrench.

It is yet another objective of this invention to provide the polyaxial power end of the wrench with a suitable connection for power tools.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Figure 1:
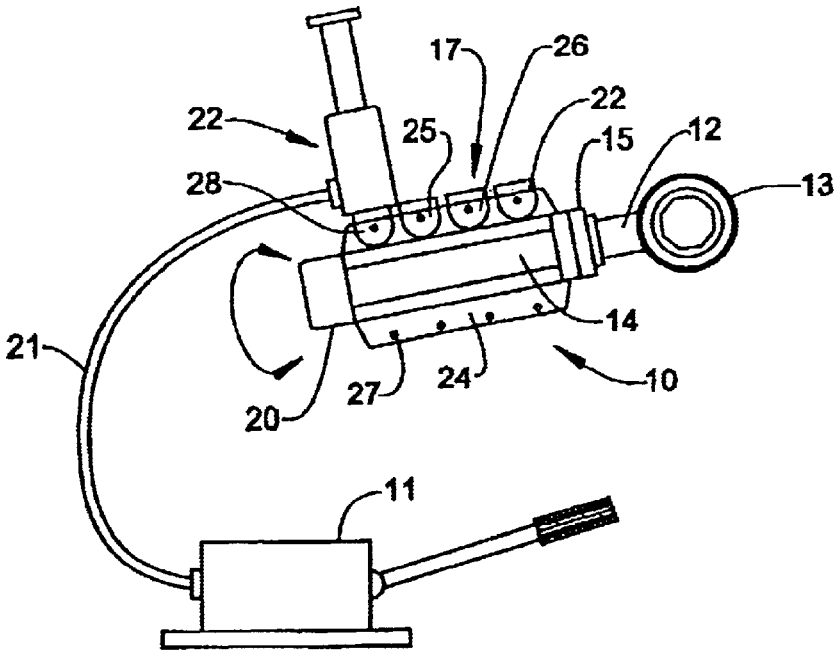
FIG. 1 is a perspective of the tool of this invention.

The polyaxial impact wrench 10, shown in FIG. 1, is illustrated connected to a manually operated hydraulic pump 11 by line 21. The impact tool 22 may be fluid operated, including gas and liquid, or electrically driven. As shown, the working end 12 of the wrench is a box end wrench 13 but it is possible that a ratchet wrench could be employed to provide torque clockwise or counter-clockwise. Also, the pump 11 may have a double acting piston to either push or pull thereby reversing the torque. A shank 14 extends longitudinally from the working end of the wrench. A shoulder 15 is fixed on the shank 14 near the working end 12. The shoulder may have the shape of a nut with planar intersecting surfaces 16.

The sleeve 17 is telescoped over the shank and engages the shoulder 15. The front end of the sleeve 17 may be countersunk. The counter sunk opening may also have intersecting planar surfaces 19 complementary with the shoulder 15. This permits the sleeve 17 to be rotated about the longitudinal axis of the shank and be selectively rigidly connected in place by the shoulder and the countersunk surfaces.

As an alternative, the shoulder may be round, as well as the interior of the countersunk sleeve, so the rotational position can be infinitely adjustable. The other end of the shank 14 has screw threads 18 which cooperate with screw threads in a lock nut 20. The lock nut 20 is tightened to lock the sleeve against the shoulder. The tightened lock nut maintains the rotational position of the sleeve. As shown in FIG. 1, the sleeve 17 has elongated flanges 23 and 24 on opposed sides. The flanges have a series of connectors 25, 26, 27 spaced along the length. The connectors may be pins, apertures or bolts which cooperate with a complementary fitting 28 on an impact tool 22 to provide a selectable point to connect the tool to the wrench 10.

Figure 2:
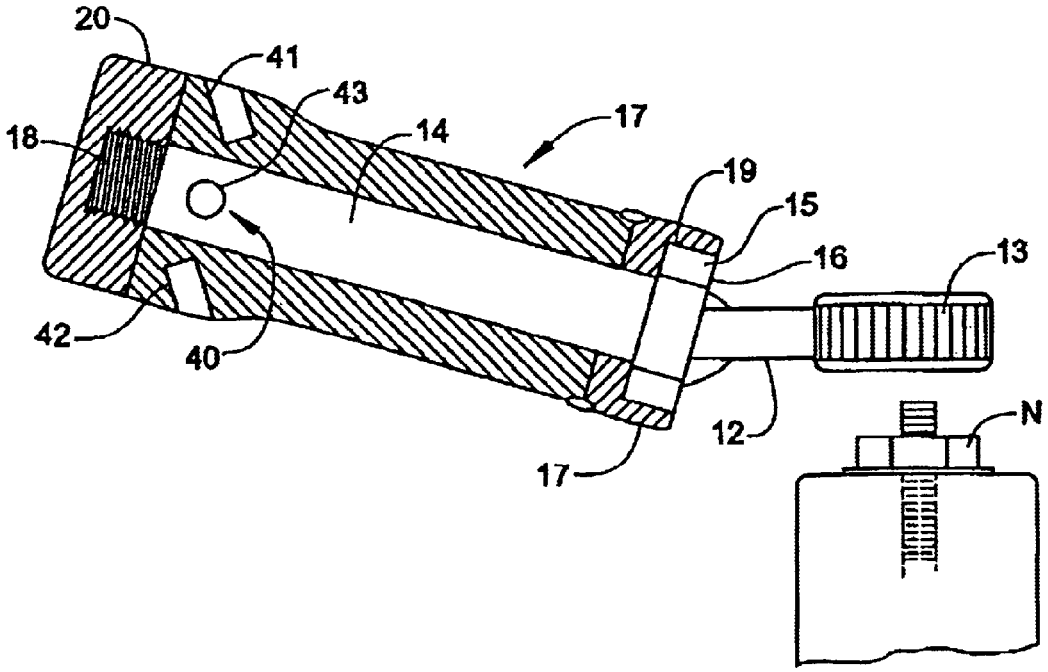
FIG. 2 is a perspective of the wrench, partially in section, shank and power end of the tool of this invention.

FIG. 2 illustrates a sleeve 17 with another connector 40 used to transfer forces from the power tool to the sleeve. In this embodiment, the sleeve has a plurality of angularly disposed bores 41, 42, 43 spaced about the circumference of the sleeve. Each of the bores may be at a different angle to the longitudinal axis of the sleeve. A complementary fitting 28 on the power tool including a pin, is inserted into whichever bore is accessible once the wrench is mounted on the bolt N. Torque may be applied to the nut through whatever vector is available in both the plane of rotation of the nut N and a perpendicular plane. In this manner, torque is adjustable polyaxially in both planes.

Figure 3:
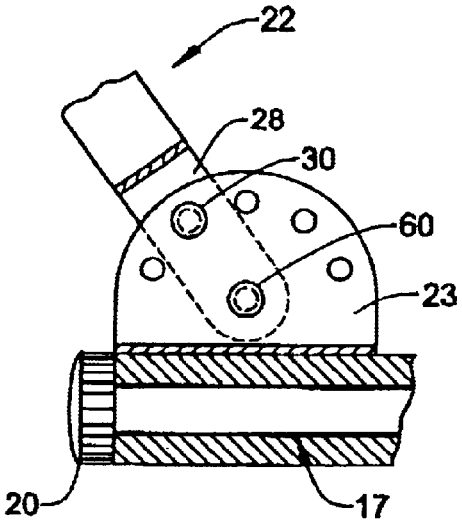
FIG. 3 is a top plan view of pivoting power end.
Figure 4:
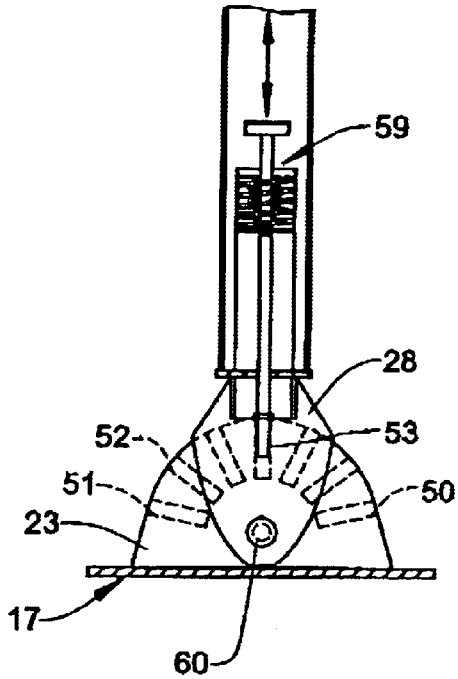
FIG. 4 is a top plan view of an alternative pivoting power end.
Figure 5:
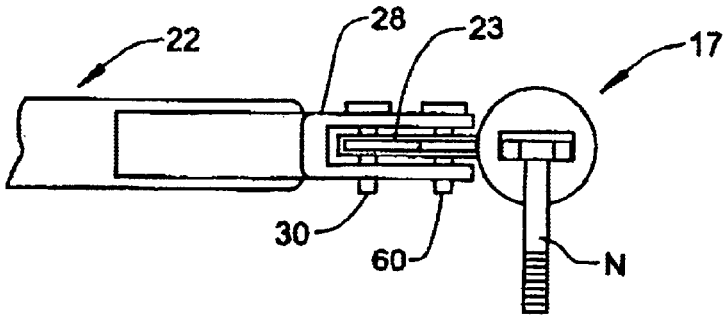
FIG. 5 is a side view, partially in section, of the power end of FIG. 3.

The sleeve 17 may have only one flange 23, as shown in FIGS. 3, 4 and 5. Also, the flange 23 may be formed in an arcuate shape with the power connector 60 in the center of the arc. Spaced about the arcuate periphery of the flange 23 are retainers 30 to provide different angular vectors of the power tool and the wrench in the plane of rotation of the nut N. The power tool 22 is connected by the complementary fitting 28 to a retainer 30 and the power connector 60 to maintain the force vector. As shown in FIGS. 3 and 5, the connectors are in the form of pins 30 that extend through apertures in the flange 23.

In FIG. 4, the arcuate flange 23 has a series of detents 50, 51, 52 in the periphery into which a pawl 53 reciprocates. The complementary fitting 28 also connects with the power connector 60 to provide different force vectors around the nut N in the horizontal plane. Also shown in FIG. 4 is a hollow adapter 59 telescoped over the complementary fitting 28 in order to extend the distance between the power tool 22 and the wrench 10.

A number of embodiments of the present invention have been described. Nevertheless, it will be understood that various modifications may be made without departing from the spirit and scope of the invention. Accordingly, it is to be understood that the invention is not to be limited by the specific illustrated embodiment but only by the scope of the appended claims.

What is claimed is:

1. A polyaxial impact wrench for applying torque to bolts and nuts comprising a working end configured to closely contact the periphery of the head of a bolt or a nut, an elongated shank rigidly extending from said working end, a sleeve mounted on said elongated shank for circumferential rotation about the longitudinal axis of said shank, said sleeve having a lock to fix said sleeve at different circumferential positions about said shank, said sleeve having connector means for selectively connecting an impact tool at a plurality of different angles to said longitudinal axis of said shank whereby torque is applied to said working end at varying angles to said longitudinal axis and circumferentially of said shank.

2. A polyaxial impact wrench for applying torque to bolts and nuts comprising a working end configured to closely contact the periphery of the head of a bolt or a nut, an elongated shank rigidly extending from said working end, a sleeve mounted on said elongated shank for rotation about the longitudinal axis of said shank, said sleeve having a lock to fix said sleeve at different circumferential positions about said shank, a flange on said sleeve extending along said longitudinal axis, said flange having a plurality of connectors oriented vertically to said longitudinal axis adapted to removably attach to an impact tool whereby torque can be applied universally to said working end in both the vertical and horizontal arc.

3. A polyaxial impact wrench of claim 2 comprising one edge of said flange attached along said longitudinal axis of said sleeve and having a free edge, said free edge of said flange shaped in an arc, a power pin located at the center of said arc, a plurality of detents located about said free edge of said arc, an arm pivotally connected to said power pin, said arm having a pawl removably contacting one of said plurality of detents fixing an angle between said arm and said longitudinal axis, said arm adapted to connect to an impact tool.

4. A polyaxial impact wrench of claim 3 wherein said detents are apertures through said flange and said pawl is a pin connected to said arm.

5. A polyaxial impact wrench of claim 2 wherein said shank having shaped longitudinal surfaces, said sleeve having cooperating longitudinal shapes providing said lock.

6. A polyaxial impact wrench of claim 2 comprising an enlarged shoulder on said shank to engage one end of said sleeve, screw threads on said shank, a nut on said shank engaging said screw threads and said sleeve, said shoulder and said nut providing said lock when tightened.

7. A polyaxial impact tool for applying torque to a nut or bolt comprising the combination of a wrench and an impact tool, a working end on said wrench configured to closely contact the periphery of the head of a bolt or a nut, an elongated shank rigidly extending from said working end, a sleeve mounted on said elongated shank for rotation about the longitudinal axis of said shank, said sleeve having a lock to fix said sleeve at different circumferential positions about said shank, a flange on said sleeve extending along said longitudinal axis, said flange having a plurality of connectors oriented vertically to said longitudinal axis of said shank, said impact tool having a longitudinal axis, said impact tool removably and adjustably attached to said connectors whereby the angle between said longitudinal axis of said elongated shank and said longitudinal axis of said impact tool is changeable and torque can be applied universally to said working end in both the vertical and horizontal arc.

* * * * *